US008419506B2

(12) United States Patent
Seyffert

(10) Patent No.: US 8,419,506 B2
(45) Date of Patent: Apr. 16, 2013

(54) DUAL CAPABILITY ULTRA HIGH PRESSURE FIRE ATTACK SYSTEM

(75) Inventor: Casparus Jan Hendrik Seyffert, Solvang, CA (US)

(73) Assignee: Cobra North America, LLC, Denver, CO (US)

( * ) Notice: Subject to any disclaimer, the term of this patent is extended or adjusted under 35 U.S.C. 154(b) by 355 days.

(21) Appl. No.: 12/753,771

(22) Filed: Apr. 2, 2010

(65) Prior Publication Data

US 2010/0186971 A1 Jul. 29, 2010

Related U.S. Application Data

(63) Continuation-in-part of application No. 12/512,874, filed on Jul. 30, 2009, and a continuation-in-part of application No. 12/512,910, filed on Jul. 30, 2009.

(60) Provisional application No. 61/137,600, filed on Jul. 30, 2008.

(51) Int. Cl.
*B24C 3/12* (2006.01)

(52) U.S. Cl.
USPC ..... 451/40; 451/90; 451/99

(58) Field of Classification Search ..... 451/90, 451/99, 75, 102, 38, 39, 40
See application file for complete search history.

(56) References Cited

U.S. PATENT DOCUMENTS

| | | | | |
|---|---|---|---|---|
| 835,541 | A * | 11/1906 | Leisegang | 451/31 |
| 1,655,767 | A * | 1/1928 | Hoevel | 451/84 |
| 2,038,249 | A | 4/1936 | Stoody | |
| 2,792,671 | A | 5/1957 | Sprigg | |
| 4,901,928 | A | 2/1990 | Abbott et al. | |
| 5,083,402 | A * | 1/1992 | Kirschner et al. | 451/99 |
| 5,407,379 | A | 4/1995 | Shank et al. | |
| 5,605,496 | A * | 2/1997 | Pickard | 451/90 |
| 2009/0250231 | A1 * | 10/2009 | Larsson | 169/70 |

OTHER PUBLICATIONS

Fairhurst, R.M. et al, "Diajet—A New Abrasive Water Jet Cutting Tool," Proceedings of the 8th International Symposium on Jet Cutting Technology, Durham, UK, Sep. 9-11, 1985, pp. 395-402.

Summers, D.A., "Waterjetting Technology," Chapters 1 through 12, published by E & FN Spon, an imprint of Chapman & Hall, London, UK, 1995.

Graettinger,A.J. et al., "Foundation Evaluation with Micro Intrusive Testing," University Transportation Center for Alabama (UTCA), University of Alabama, UTCA Report No. 01114, Dec. 2002, 36 pages.

Jetstream of Houston, Inc., Catalog, http://www.asiawaterjet.com/Jetstream-2520MainCatalog.pdf, 1998.

(Continued)

*Primary Examiner* — Robert Rose
(74) *Attorney, Agent, or Firm* — HolzerIPLaw, PC

(57) ABSTRACT

A dual capability ultra high pressure (UHP) fire attack system includes a fluid jet assembly and an UHP attack line system. The fluid jet assembly and the UHP attack line system are coupled to a high pressure fluid source. The fluid is discharged from both the fluid jet assembly and the UHP attack line system as a mist have a droplet diameter of approximately 150 microns. When infused with an abrasive material, the fluid jet assembly may be used to cut through structural surfaces, so that a fire may be "knocked down" before the fuel source is attacked.

22 Claims, 7 Drawing Sheets

OTHER PUBLICATIONS

A typical spraying gun that might be attached to a garden hose, http://www.aquatix-2u.co.uk/acatalog/adjustable__car__care__spray__gun.html, downloaded Dec. 28, 2020, 1 page.

A higher pressure control system, http://www.northerntool.com/shop/tools/product__273__273, downloaded Dec. 28, 2010, 2 pages.

A lance extension to fit into a pressure washer gun, http://pressureparts.com/ImageView.aspx?code=4760262, downloaded Dec. 28, 2010, 1 page.

A conventional high pressure cleaning lance, http://www.advancedpressuresystems.com/40K-Water-Blasting__Products.htm?cat=10, downloaded Dec. 28, 2010, 2 pages.

A two-trigger gun, http://www/advancedpressuresystems.com/APS-control-gun-html?cat=5, downloaded Dec. 28, 2010, 2 pages.

A disassembled two-trigger gun, http://advancedpressuresystems.com/images/PDF/15K-Hand%20Guns-2010-Catalog-Pages.pdf, downloaded Dec. 28, 2010, 1 page.

Ultra-high pressure nozzle assemblies, http://www.alljetting.com/controlguns.htm, downloaded Dec. 28, 2010, 1 page.

An ultra-high pressure cleaning lance assembly, http://www.alljetting.com/controlguns.htm, downloaded Dec. 28, 2010, 1 page.

An abrasive injection lance, http://www.aquamiser.com/blasting-guns.html, downloaded Dec. 28, 2010, 1 page.

A high-pressure gun with hose connection in front of the trigger, http://woma-products.com/pdf/p__tools__e.pdf, downloaded Dec. 28, 2010, 1 page.

Protective pipe in tube cleaning, http://www.peinemannequipment.com/products.bundle__cleaning/single__lance__tube__cleaneer/, downloaded Dec. 28, 2010, 2 pages.

* cited by examiner

DUAL CAPABILITY ULTRA HIGH PRESSURE FIRE ATTACK SYSTEM

CROSS-REFERENCE TO RELATED APPLICATIONS

The present application is a continuation-in-part of U.S. Nonprovisional patent application Ser. No. 12/512,874, entitled "Fluid Jet Assembly" and filed on Jul. 30, 2009, which claims the benefit of priority of U.S. Provisional Patent Application No. 61/137,600, entitled "Ultra High Pressure Fire Attack System" and filed on Jul. 30, 2008; and is also a continuation-in-part of U.S. Nonprovisional patent application Ser. No. 12/512,910, entitled "Fluid Jet Manifold" and filed on Jul. 30, 2009, which claims the benefit of priority of U.S. Provisional Patent Application No. 61/137,600, entitled "Ultra High Pressure Fire Attack System" and filed on Jul. 30, 2008, the full disclosures of which are specifically incorporated by reference herein for all that they disclose or teach.

BACKGROUND

Fluid jet systems have many applications, such as firefighting, surface cleaning, hydroexcavation, demolition, machining, mining, etc. Typical fluid jet systems provide a cutting or abrading function by projecting a jet of fluid at high velocity and pressure at a structure or surface. The specific fluid employed depends on the application. For example, for firefighting applications, a combination of water and an abrasive material may be employed to penetrate a wall or ceiling of a structure having a fire within, and upon creating a hole in the wall or ceiling, the abrasive material flow may be terminated while continuing the water flow through the hole to knock down the fire.

While existing fluid jet systems used in firefighting applications will knock down a fire, they generally cannot extinguish fires. When an existing fluid jet system is used to attack a fire, it is used for thermal layer control. More specifically, the small droplets of water emitted by existing fluid jet systems cool the layer of gas above the fire, interrupting the flame chain reaction of the combustion process. A fire attacked by existing fluid jet systems will generally continue to smolder until it redevelops in a free burning phase or a voluminous amount of water is applied to the burning substance.

In order to apply the volume of water necessary to extinguish a fire via standard pressure firefighting techniques, specialized equipment is often required. Large, highly specialized trucks are necessary to transport water to the fire and/or pump water from nearby water sources. Standard attack line hoses used for application of water to the fire are long (typically 50 feet), bulky (varying in diameter from 1½ inches to 3 inches), and heavy, requiring multiple people for deployment and use. Further, most of the water applied to a fire using standard pressure firefighting techniques is seen as run-off.

SUMMARY

Implementations described herein address the foregoing problems by providing a dual capability ultra high pressure (UHP) fire attack system. The dual capability UHP fire attack system includes a fluid jet system having a non-pressurized lance barrel through which a high pressure hose ("a lance hose") is inserted and anchored at the distal end of the lance barrel, relative to an operator's position. The other end of the lance hose is coupled to a high pressure fluid source. In this manner, the fluid can be fed into the lance hose and transported to the output of the lance barrel, where it is discharged as a fluid jet stream.

A nozzle is mounted at the distal end of the lance barrel, at the output of the lance hose, to control the characteristics of the fluid jet flowing out of the lance hose. For example, in one implementation, fluid is discharged from the lance hose under high pressure and through the nozzle to yield a fluid jet stream having droplets of appropriate size and velocity to effectively knock down a fire. When infused with an abrasive material, the fluid jet stream exits the nozzle in a focused jet capable of cutting through most structural surfaces.

The dual capability UHP fire attack system also includes an UHP attack line system that includes a high pressure hose ("an attack hose") coupled to a high pressure fluid source. The dual capability system allows for selection between the fluid jet system and the attack line system. For example, in one implementation, once the fluid jet system is used to knock down the fire, the attack line system is selected by an operator to efficiently apply water having droplets of appropriate size and velocity to extinguish the knocked down fire.

Other implementations are also described and recited herein.

BRIEF DESCRIPTIONS OF THE DRAWINGS

DETAILED DESCRIPTIONS

Figure 1:
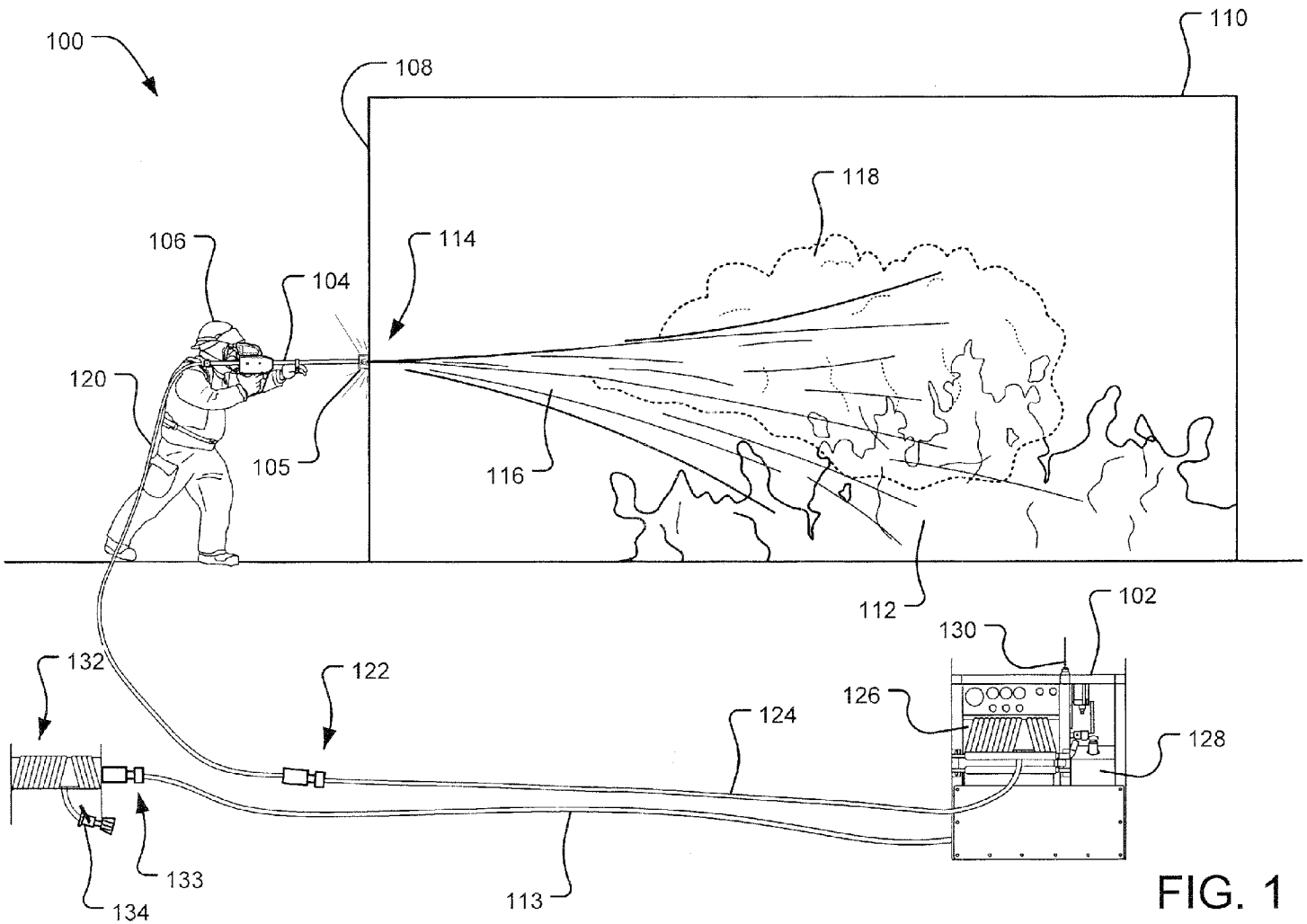
FIG. 1 illustrates an example of a dual capability ultra high pressure (UHP) fire attack system including fluid jet assembly and an attack line system used in a firefighting application.

FIG. 1 illustrates an example of a dual capability ultra high pressure (UHP) fire attack system 100 used in a firefighting application, the dual capability UHP fire attack system 100 including a base station 102, fluid jet assembly 104 (also referred to as lance 104), and an UHP attack line system 132. The dual capability UHP fire attack system 100 is used to apply fluid to a fire. Example fluids may include without limitation water, combinations of water and an abrasive material, combinations of water and foam, etc. The specific fluid employed depends on the application. Under certain circumstances, for example, a flow of fire retardant foam may be combined with the water flow to enhance the suppression of a fire (e.g., coating the fire's fuel to reduce its contact with oxygen).

In the example shown in FIG. 1, a firefighter 106 is shown holding the distal end of the lance 104 against a wall 108 (or door) of an enclosure 110 in which a fire 112 is burning. The lance 104 includes a rigid lance barrel through which high pressure fluid flows during operation. The rigid lance barrel allows the firefighter 106 to accurately direct the fluid flow and to steady the lance 104 against a surface, such as the wall 108. The firefighter 106 initially cuts through the wall 108 using a combined flow of high pressure water and abrasive material. When the wall 108 is penetrated, the firefighter ceases the flow of abrasive material while continuing the flow of water, which streams into the enclosure 110 through the newly cut hole 114 in the wall 108 in a high pressure jet 116 having small water droplet size (e.g., approximately 0.0059 inches or 150 microns in diameter) and a high velocity (e.g., approximately 400-450 mile per hour or 200 meters per second). The water characteristics are such that water jet extends a considerable distance (e.g., over 40 feet) into the enclosure 110, despite convection currents caused by the fire 112, and knocks down the fire 112. Much of the water in the high pressure jet 116 is vaporized (as shown by steam 118), reducing the intensity of the fire 112 and the temperature in the enclosure 110. In this manner, the fluid jet system 100 knocks down the fire and makes it safer for firefighters to enter the enclosure 110 to progress their firefighting activities. However, it should be understood that technology described and claimed herein may be employed in other applications, including surface cleaning, hydroexcavation, demolition, machining, mining, etc.

In preparation for applying the fluid jet system 100 to the fire 112 in the enclosure 110, the firefighter 106 takes a steady stance, holds the lance 104 against his shoulder and with both hands (e.g., one hand in the trigger guard of the lance 104 and the other on a handle located forward of the trigger guard on the lance barrel), and places a placement structure at the distal end of the lance 104 against the wall 108. In one implementation, the placement structure is embodied by a 3-pronged offset fixture 105 with a splash plate to protect the operator from spray-back of fluid and debris during the cutting operation. Other placement structures may be employed to steady or aim the fluid jet at a target region of a structure. In some implementations, cutting performance of the fluid jet is improved if the placement structure allows the operator to "wiggle" the fluid jet about the target region. In this manner, the hole that is cut in the structure by the fluid jet develops as larger diameter than the fluid jet itself, thereby allowing fluid and debris to evacuate during the cutting operation.

In the illustrated implementation, the lance 104 includes two triggers: (1) a trigger to control the flow of water from the base station 102 through the lance 104; and (2) a trigger to control the flow of abrasive material from an abrasives holding tank in the jet base station 102 through the lance 104. To commence the cutting stage, the firefighter 106 pulls both triggers and a combined flow of water and abrasive material flows at high velocity against the wall 108, quickly cutting a small hole through the wall 108. After the wall 108 is penetrated by the water/abrasive material combination, the firefighter 106 releases the abrasive material trigger and continues the flow of high pressure water through the lance 104, through the hole in the wall 108, and into the enclosure 110 to knock down the fire 112. However, it should be understood that, when it is unnecessary to cut a hole, the abrasive material need not be applied. Further, in some implementations, such as those used to attack wildland fires, the aggregate system may be unnecessary The lance 104 includes a lance hose 120, which threads through the barrel of the lance 104 and is anchored to the distal end of the lance 104. The lance hose 120 threads out of the proximal end of the lance 104 a safe distance (e.g., from a few feet to over several yards away) away from the firefighter 106 to a high pressure coupling 122, which couples the lance hose 120 to an ultra high pressure (UHP) hose 124 extending from the base station 102.

In an implementation, the pressure of the discharge from the lance may vary between 1500 pounds per square inch and 4400 pounds per square inch. Further, this pressure may be selected by the user. It should be appreciated that pressure may vary based on flow rate and the physical constraints (hose diameter, nozzle diameter, etc.) of the system. For example, at 7 gallons per minute, fluid may be discharged from the lance at 1500 psi to 3500 psi. At 10 gallons per minute, fluid may be discharged from the lance at 1500 psi to 4000 psi. At 15 gallons per minute, fluid may be discharged from the lance at 1500 psi to 4400 psi.

Once the intensity of the fire 112 is reduced (or knocked down), the firefighter 106 can "put the wet stuff on the red stuff" using the UHP attack line system 132 to attack the fuel phase of the fire 112. The UHP attack line system 132 is connected to base station 102 via a high pressure coupling 133, which couples the UHP attack line system to an UHP hose 113 connected to the base station 102. Water is dispensed from the UHP attack line system 132 via an UHP nozzle 134. The working pressure of the UHP attack line system may be varied between approximately 400 psi and 1400 psi. In an implementation, the working pressure of the UHP attack line system may be selected by the user.

In the illustrated implementation, the hose of the UHP attack line system 132 is wound around a portable hose reel. However, it should be understood that this hose reel (or other hose containment device) may be incorporated into the base station, or may be mounted on a vehicle. In still other implementations, a hose reel may not be used. In an implementation, the hose of the UHP attack line system 132 may be of a smaller diameter (approximately ½ inch) than hoses used in standard pressure firefighting techniques. In this manner, water pressure in the UHP attack line system is increased. Further, because UHP attack line hose is smaller in diameter and lighter than standard pressure firefighting hoses, the UHP attack line hose may be easier to maneuver, allowing for quick deployment, particularly in distances over 100 feet. Additionally, the UHP attack line system may be operated by a single user.

The UHP attack nozzle 134 dispenses water in a flow having small water droplet size (e.g., approximately 0.0059 inches or 150 microns in diameter) and high velocity compared to standard pressure firefighting techniques. The small water droplet size dispensed by the UHP attack line nozzle 134 permits the fire 112 to be extinguished significantly more efficiently than if it were extinguished via traditional standard pressure firefighting techniques. The application of very small water droplets to a fire at a very high pressure increases the surface area of water available for heat absorption and allows a fire to be extinguished with significantly less water than is necessary using standard pressure firefighting techniques. For example, at 1500 psi, the surface area available of a 7 gallon per minute flow of 150 micron diameter droplets is roughly equivalent to that of a 438 gallon per minute flow of standard water droplets. Thus, the dual capability ultra high pressure fire attack system may provide for a fire to be extinguished when limited water is available, or when traditional firefighting apparatus are unable to access the fire.

Further, with respect to water droplet size, smaller water droplets fall to the ground more slowly than larger droplets. For example, a 150 micron diameter water droplet falls at approximately 0.6 meters per second, while a standard 500 micron diameter water droplet falls at approximately 2 meters per second. Because smaller water droplets fall slowly, they can travel to the source of the heat using air currents of the fire space. When water is dispensed in droplets of approximately 150 microns, it may be referred to as a water mist.

The expansion of small water droplets can also help extinguish a fire. When small water droplets are exposed to heat and evaporate, the small water droplets expand approximately 1900 fold. This expansion displaces air (including oxygen) around a fire. Reducing oxygen around the fire to approximately 7% to 13% may extinguish a fire.

Additionally, water mist helps block radiation of heat by effectively absorbing and dispersing radiant heat given off by a fire. This reduces the feedback to the fuel surface of the fire and, in turn, reduces the pyrolysis rate. Additionally, use of water mist can provide a radiation shield to firefighters or other persons in contact with a fire.

The base station 102 includes a motorized hose reel 126 that allows the UHP hose 124 to be extended during operation and retracted during storage. In the illustrated implementation, the base station 102 also includes, among other components, a power source (such as a diesel or gasoline engine), a fluid source (such as a water intake hose or reservoir), an abrasives holding tank 128, a communications system (see antenna 130), a high pressure pump, multiple valves with one or more valve manifolds, a flow junction for combining multiple flows (e.g., a water flow and an abrasive material flow), a second UHP hose 113 to connect the UHP attack line to the base station 102, and a selector for selecting between the fluid jet assembly 104 and the UHP attack line system 132.

Figure 2:
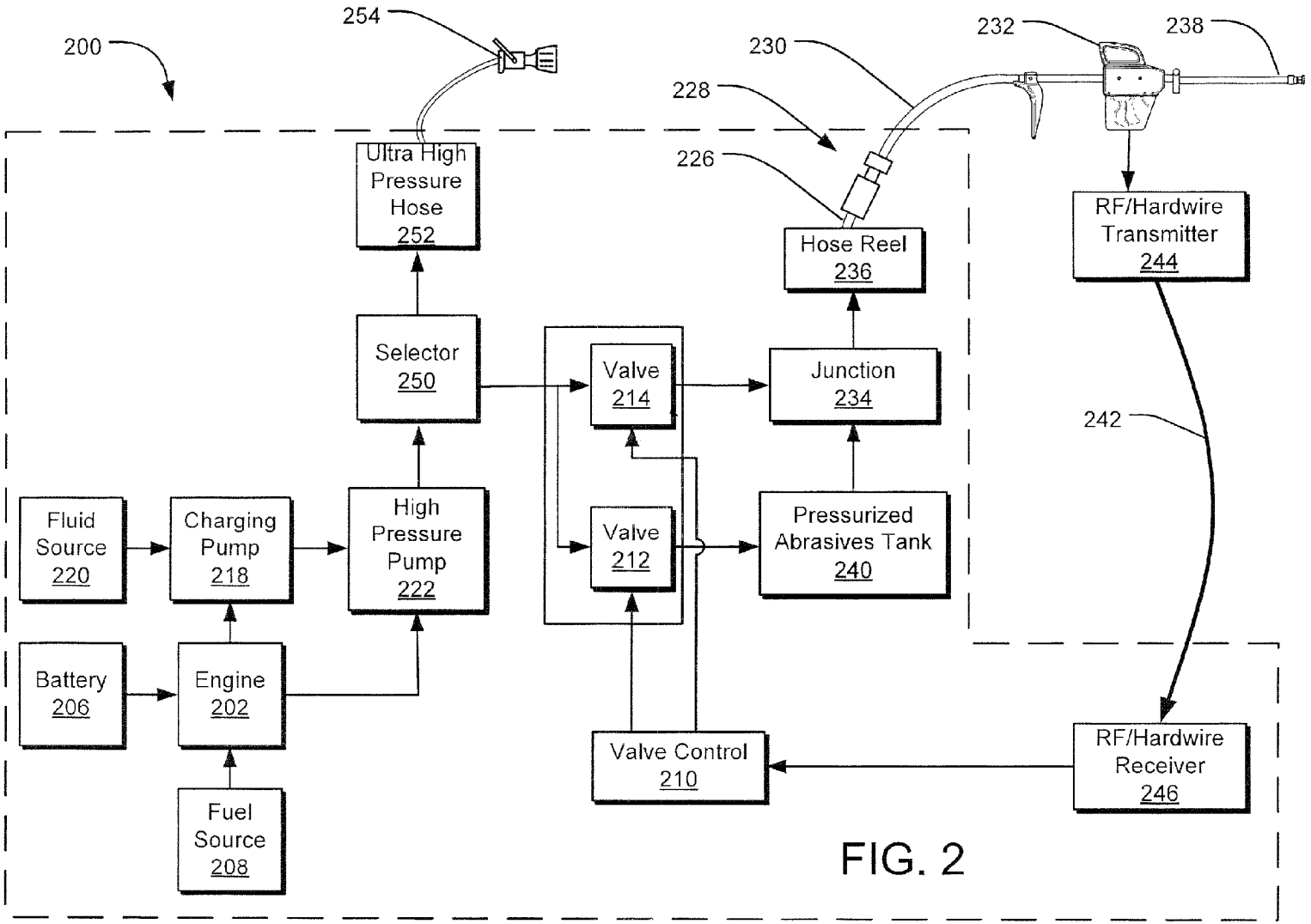
FIG. 2 illustrates a hydraulic schematic of an example dual capability UHP fire attack system.

FIG. 2 illustrates a hydraulic schematic of an example dual capability ultra high pressure fire attack system 200. An engine 202 powers a base station 204. In one implementation, the engine 202 is embodied by a single DEUTZ naturally aspirated 50 hp diesel engine, although other engines or power sources may be employed, including gasoline engines, electric motors, hybrid engines, etc. Further, it should be appreciated that two or more gasoline engines, diesel engines, electric motors, hybrid engines, etc. may be employed in combination to power the base station. In the system illustrated in FIG. 2, an electricity source, such as a battery 206, provides electrical power for an automatic ignition used to start the engine 202 and a fuel source 208 (e.g. a diesel fuel tank) provides fuel to the engine 202. The battery 206 also provides power to a valve control circuit 210, valves 212 and 214 and a radio frequency (RF) or hardwire receiver 216. Although more than one engine may be employed, the single normally aspirated DEUTZ air cooled diesel engine 202 provides consistent power and allows sufficient operation under almost any weather conditions and altitudes. Further, the engine 202 provides a very short start-up time and rapid deployment of the fluid jet system 200 without complicated control systems and frequent maintenance.

The engine 202 provides power to a charging pump 218, which pulls fluid from a fluid source 220, such as a water intake or reservoir, and provides a fluid flow with positive pressure for the input of a high pressure pump 222. The high pressure pump 222 is driven by the main shaft of the engine 202 via a poly carbon drive belt. In one implementation, the pump 222 is capable of discharging fluid at a pressure of approximately 4,400 PSI (300 bar) at a flow rate of 15 gallons per minute (GPM) (60 liters per minute) via a 1.2 inch outer diameter, 0.5 inch inner diameter high pressure hose system (e.g., a base station hose 226, a coupling 228, and a lance hose 230 or ultra high pressure hose 252 and ultra high pressure attack system 254). It should be understood that other dimensions of hose may also be employed.

In one implementation, the pump 222 may be embodied by a single UDOR ultra high pressure force pump having dimensions of 15"L×16.5"W×9"H, although other pump assemblies may be employed. An example pump 222 may include without limitation a 35 mm solid keyed shaft, a brass manifold, a stainless steel check valve, stainless steel plungers, bronze connecting rods, tapered roller bearings, solid ceramic plungers, a heat treated crankshaft, a heavy duty flat base, high pressure seals, and an 80 oz oil crank case, although other designs may be employed. In other implementations, more than one pump may be employed.

A selector 250 determines whether the dual capability ultra high pressure fire attack system 200 operates the fluid jet assembly or the ultra high pressure attack line system. In an implementation, the selector 250 may be a high pressure three-way ball selector valve, such as a three way ball valve. It should be appreciated, however, that any mechanical or electromechanical selector suitable for high pressure applications may be used.

When the selector 250 is set to operate the fluid jet assembly, the pump 222 drives fluid at high pressure into the valves 212 and 214, which are set in a manifold 224. The valves 212 and 214 are independently controlled by the valve control circuit 210, which can be controlled wirelessly or via a hardwired communications link from a lance 232, or alternatively via a manual override circuit having access to the base station 204.

The valve 214 drives high pressure fluid through the junction 234 and the hose reel 236 into the high pressure hose assembly, through the lance 232 and out a nozzle 238 of the lance 232. The other valve 212 feeds into a pressurized abrasives holding tank 240, which contains abrasive material that improves the cutting performance of the fluid flow during a cutting stage of operation. In one implementation, the pressurized abrasives holding tank 240 is a 2.5 gallon vessel mounted to the base station 204. An abrasive material, such as PYROSHOT abrasive additive, another inert, non-metallic abrasive material, such as sand, diamond-cut granite, ground garnet, etc., or some other abrasive material, is loaded into the abrasives holding tank 240, which is then pressurized with fluid flow from the value 212 when the valve 212 is opened. When the valve 212 drives pressurized fluid through the abrasives holding tank 240, a combination of fluid and abrasive is driven to a junction 234, where it combines with the fluid flow from the valve 214. As such, when both valve 212 and valve 214 are open, a combination of abrasive material and fluid is driven out of the abrasives holding tank 240 and through the high pressure hose assembly and the lance 232 to the nozzle 238 for application to the target surface, such as to cut through a structure or clean the target surface.

In one implementation, a single manifold block 224 contains the valves 212 and 214 and regulates the pressure of the fluid flow output from each valve to achieve a desired mixture ratio of abrasive material to fluid, although it should be understood that each valve 212 and 214 may have its own separate containment. In one implementation, 5% of the fluid output from the lance 232 is abrasive material, although other mixture ratios may be employed. For example, 8% is also proposed as an effective mixture ratio. It is believed that a mixture ratio of between 2.5% and 40% may be acceptable, but for some applications, the mixture ratio may fall outside of this range. To achieve a desired mixture ratio, considering the additional hydraulic resistance introduced in the abrasives line by the abrasives holding tank 240, the individual outputs of each valve 212 and 214 are fed through individual channels of the manifold 224, wherein each manifold channel is preconfigured to achieve the appropriate abrasive-to-fluid mixture ratio.

The valves 212 and 214 can be controlled remotely from the lance 232 via a wireless (RF) or hardwired communications link 242. A transmitter 244 in (or communicatively coupled to) the lance 232 transmits signals to a receiver 246 in (or communicatively coupled to) the base station 204. The lance 232 includes separate triggers to independently control the flows of fluid and abrasive material through the system (although, in one implementation, abrasive material flow fed by the valve 212 is restricted when no fluid flows through valve 214). Each trigger sends signals to the base station 204 to open or close the valves 212 and 214. An operator can close neither trigger (e.g., the system is in standby mode), one of the triggers (e.g., typically, only fluid without abrasive material flows), or both triggers (e.g., both fluid and abrasive material flows). For example, to execute a cutting operation, a firefighter closes both triggers to cut a hole in a structure using a high pressure combination of water and abrasive material; to execute the knock down operation on the fire, the firefighter closes only the trigger controlling the valve 214, which provides high pressure water through the newly cut hole and into a burning room on the other side of the structure.

When the selector 250 is set to operate the ultra high pressure attack line system, the pump 222 drives fluid at high pressure into the ultra high pressure hose 252, which directs the fluid flow into the UHP attack line system 254. The ultra high pressure hose 252 and the UHP attack line system 254 may be connected via a high pressure coupling (not shown). In this mode, an operator can used the UHP attack line system 254 in a manner similar to standard pressure firefighting techniques.

Because both the fluid jet assembly and the UHP attack line system are under extremely high pressure when in use, it should be appreciated that one or more dump valves may be used throughout the systems to relieve pressure in the respective systems as necessary. For example, these dump valves may be used to drain the respective systems after use. Further, in some implementations, one or more blow-off valves may be used as a safety feature in the respective systems to ensure that the maximum allowable pressure of the system is not exceeded.

Further, while a single pump system is illustrated, it should be appreciated that two pump systems may be configured in parallel, such that one pump supplies fluid to the fluid jet assembly, one pump supplies fluid to the UHP attack line system, and a selector permits a user to select between the two systems. In still other implementations, each pump in a two pump system may be configured to be operable independent of the other pump.

FIGS. 3-7 illustrate various views of at base station 300 for an example dual capability ultra high pressure (UHP) fire attack system, although it should be understood that alternative implementations may be employed. Various components of the base station 300 may be found in any of FIGS. 3-7, although such components may be discussed with regard to a specific Figure even if the component is not visible in that Figure.

Figure 3:
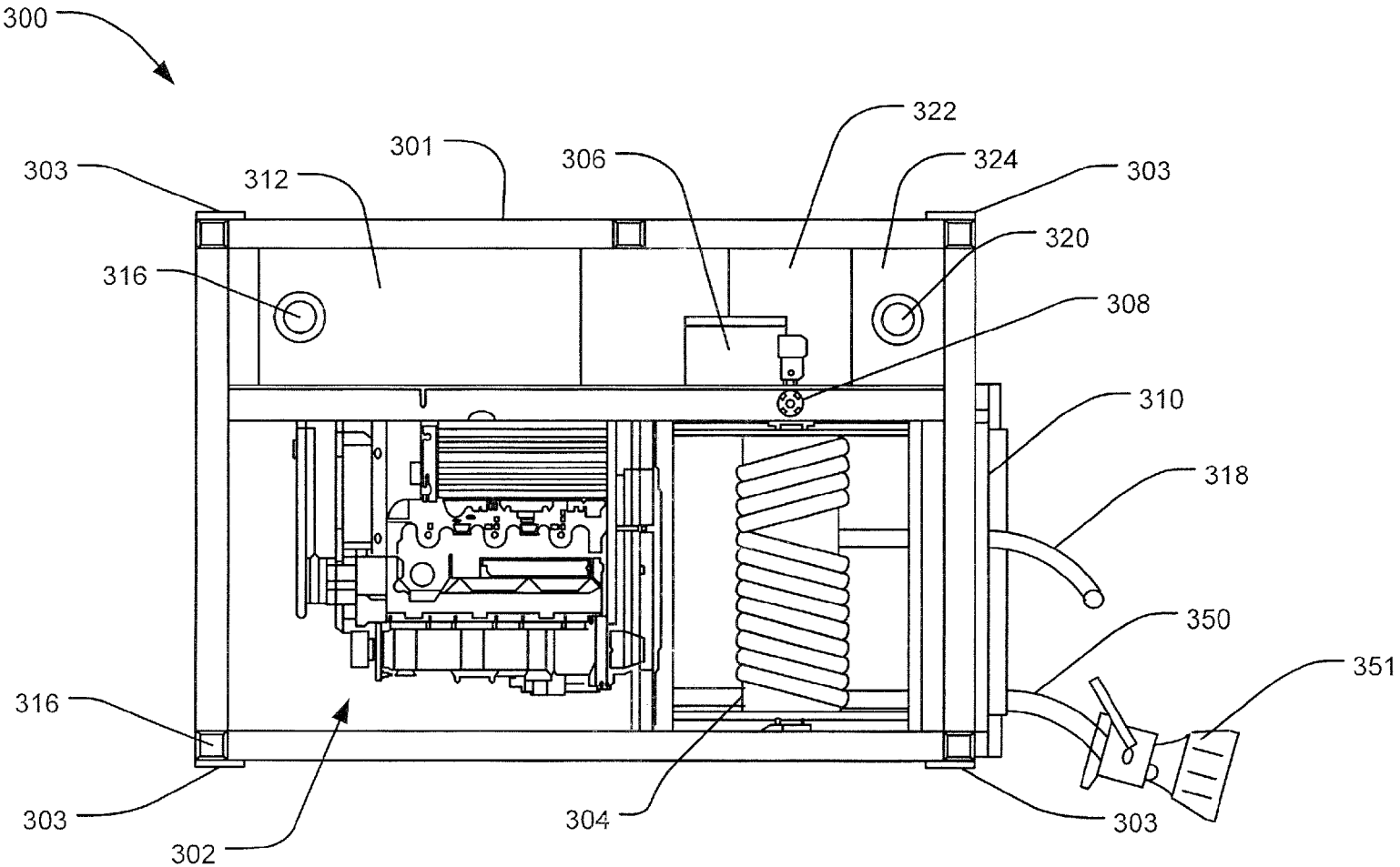
FIG. 3 illustrates a plan view of a base station for an example dual capability UHP fire attack system.

FIG. 3 illustrates a plan view of a base station 300 for an example dual capability UHP fire attack system. The base station 300 is generally housed within a sturdy steel frame 301. In one implementation, the frame 301 is 48 inches by 34 inches by 36 inches, and the self-contained base station 300 weighs approximately 1500 pounds. The frame 301 includes several sturdy steel eyelets 303 to facilitate transport of the base station 300 to a location of operation (e.g., the eyelets can receive cabling to secure the base station 300 on a truck, fork lift or other apparatus).

The base station 300 is powered by an engine 302 to drive a charging pump, if appropriate, and a high pressure pump 332 (see FIG. 7) and provides electrical power to a motorized hose reel 304, a communications system (see receiver module 306 and antenna 308), and a control system (see control panel 310). The engine 302 receives fuel from a fuel tank 312 and electrical current from a battery 314 (see e.g., FIG. 4). Access to the fuel tank 312 (e.g., for refueling) is provided through fuel input 316.

The base station 300 includes the hose reel 304, which allows or employs a motor to assist extension of the base station hose 318 as the operator carries the lance (see e.g., lance 104 of FIG. 1) to a remote location (e.g., to an outside wall of a burning structure). The base station hose 318 is typically connected to a lance hose (see e.g., lance hose 120 of FIG. 1) via a high pressure coupling (see e.g., coupling 122 of FIG. 1). The motor of the hose reel 304 also assists with retraction of the base station hose 318 when extending the base station hose 318 is no longer needed. However, it should be appreciated that multiple hose reels may be housed within the base station, or that one or more hose reels may be located external to the base station.

The base station 300 also includes a pressurized abrasives holding tank 326 (see FIG. 4 and see e.g., abrasives holding tank access 320 and faces 322 and 324 of the abrasives holding tank compartment in FIG. 3) that stores abrasive material and feeds the abrasive material into the fluid flow during a cutting operation. The high pressure pump 332 drives fluid at a high pressure into the abrasives holding tank 326 (see FIG. 4) when the appropriate manifold valve is open. It should be understood that cutting is merely an example application of the abrasive material flow. Other applications, such as surface cleaning, hydroexcavation, demolition, drilling, mining, etc. may also employ an abrasive material flow.

An UHP hose 350 extends from the base station 300 to provide fluid flow from the pump in the base station to the nozzle of the UHP attack line system 351.

Figure 4:
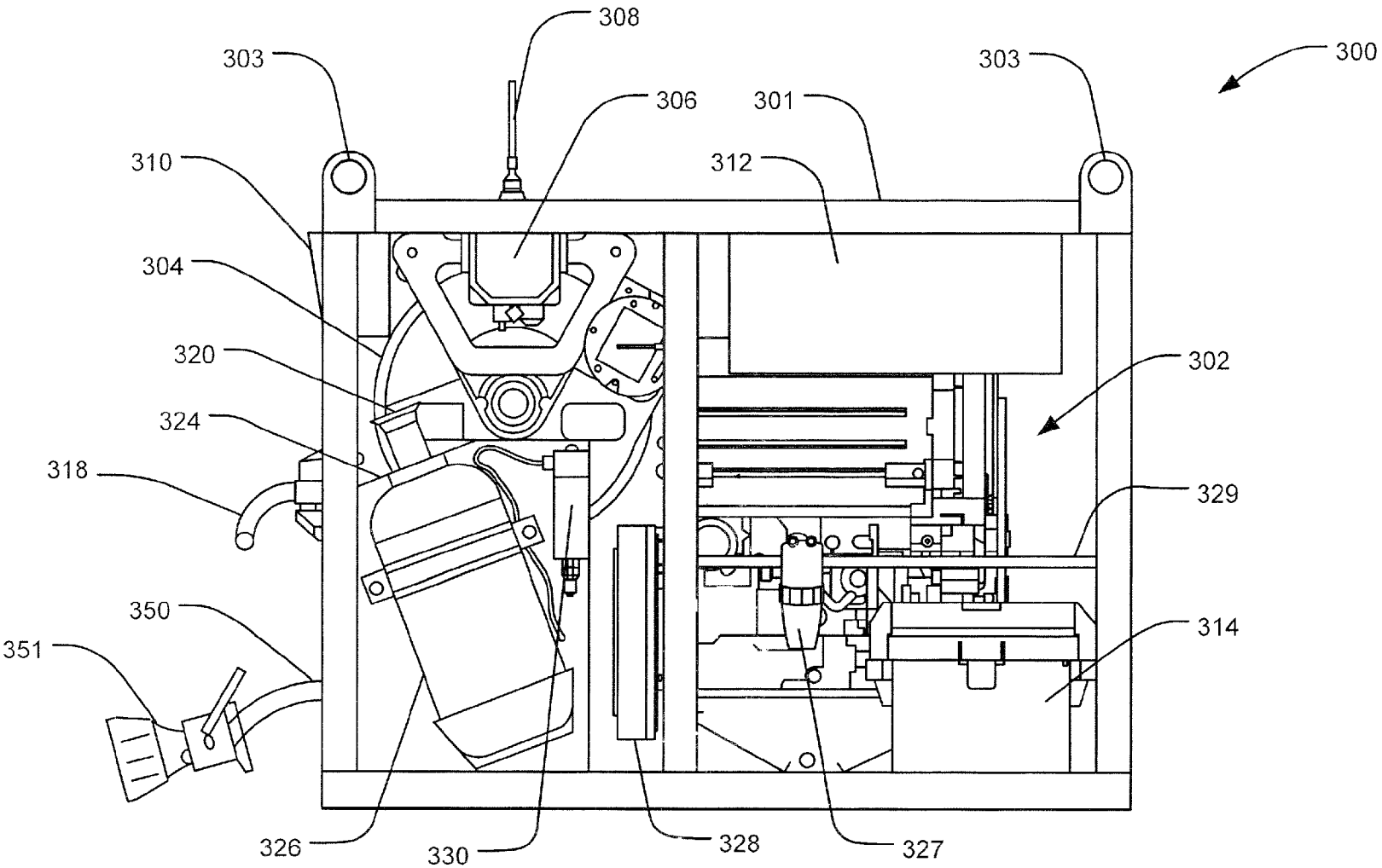
FIG. 4 illustrates a right side view of a base station for an example dual capability UHP fire attack system.

FIG. 4 illustrates a right side view of a base station 300 for an example dual capability UHP fire attack system. The engine 302 is shown with the fuel tank 312 and battery 314. A drive belt drive 328 is shown powered by the engine 302. The drive belt 328 drives the high pressure pump 332 (see FIG. 7). An inline filter 327 is shown with an intake pipe 329 (extending from the periphery of the base station 300 and connecting to the side of the inline filter 327) and an outlet pipe (extending from the other side of the inline filter 327 into the interior of the base station 300 to feed into the high pressure pump 332). The intake pipe 329 can be connected to a fluid source, such as a hose from a fluid reservoir of a nearby fire truck. In one implementation, an inline charging or supply pump (not shown) may also be used to maintain input pressure on the high pressure pump 332. This charging or supply pump may be driven by a second drive belt (not shown) powered by the engine 302.

The engine 302 and the other components of the base station are mounted to the frame 301, which has eyelets to assist with transport. An antenna 308, with receiver module 306, is mounted at the top of the frame 301 to facilitate reception of wirelessly transmitted commands from the lance. A control panel 310 is mounted on the front of the frame 301 to present gauges and various operator-accessible controls. The base station hose 318 extends out the front of the base station 300 from the motorized hose reel 304.

An abrasives holding tank 326 is contained within an abrasives holding tank compartment (see e.g., compartment face 324). Two manifold valves and a shared manifold 330 are mounted within the abrasives holding tank compartment to regulate the flows of fluid and abrasive material. The inputs to the valves are driven by the high pressure pump 332 and the manifold 330 has output for each valve, one of which feeds into the abrasives holding tank 326 and the other which feeds into a junction (not shown) to combine with output flow from the abrasives holding tank 326.

An UHP hose 350 extends from the base station 300 to provide fluid flow from the pump in the base station to the nozzle of the UHP attack line system 351.

Figure 5:
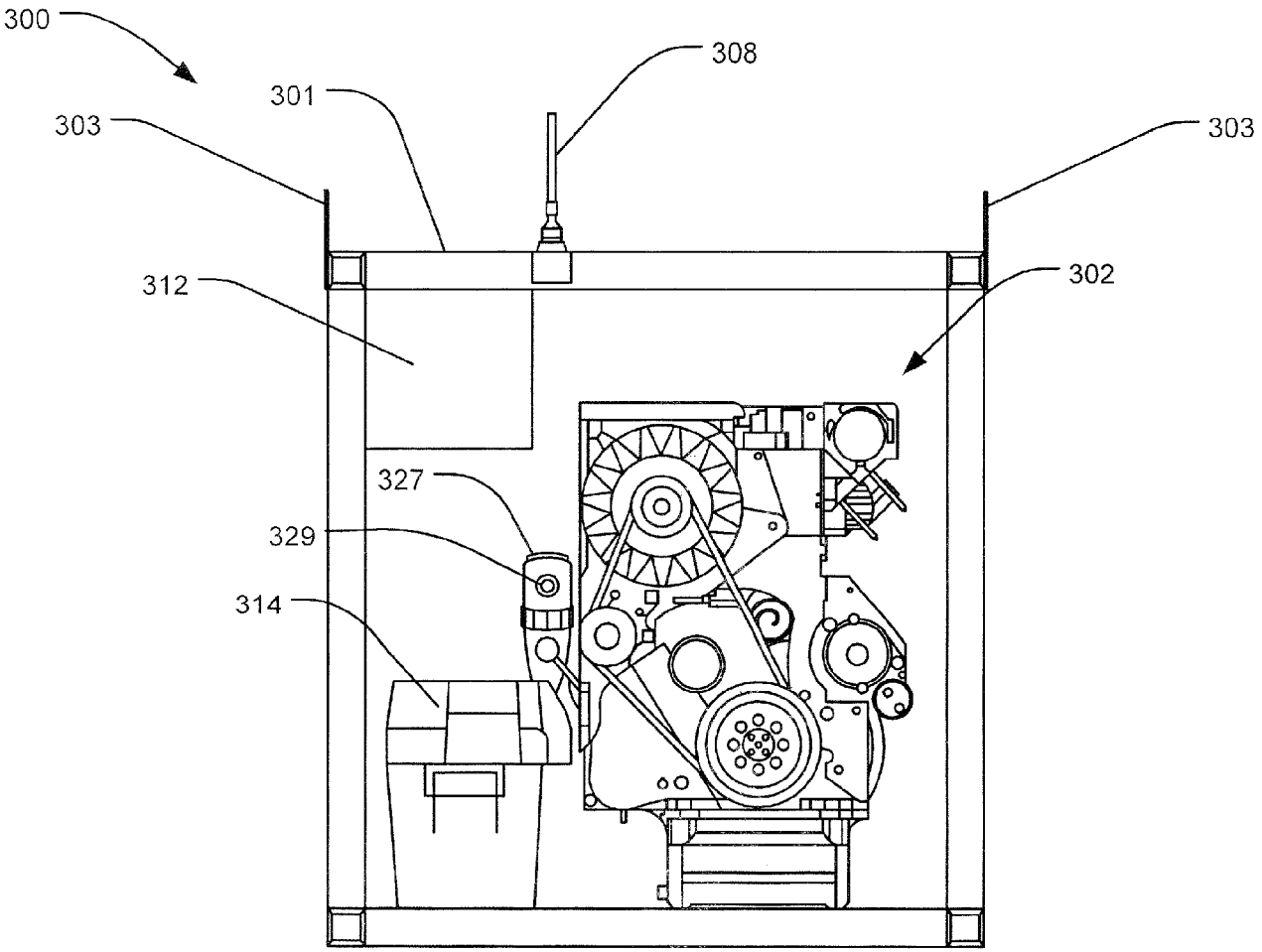
FIG. 5 illustrates a back view of a base station for an example dual capability UHP fire attack system.

FIG. 5 illustrates a back view of a base station 300 for an example dual capability ultra high pressure fire attack system. A majority of the base station components are not visible in the view for FIG. 5. Nevertheless, the engine 302, the battery 314, the fuel tank 312, the eyelets 303, the inline filter 327, the intake pipe 329, and the antenna 308 are illustrated in FIG. 5 being mounted to the frame 301.

It should be understood, however, that alternative implementations may be employed. For example, in one implementation, the base station is mounted in or to a vehicle for transport. For example, components of the base station may be separately mounted to a fire department vehicle and powered by an auxiliary drive train connected to the vehicle's engine. The hose reel is mounted to an operator-accessible compartment on the vehicle to allow an operator to connect the base station hose to a lance hose. The operator can then extend the base station hose to pull the lance into the specific area of operation (e.g., against a wall to a burning structure).

Figure 6:
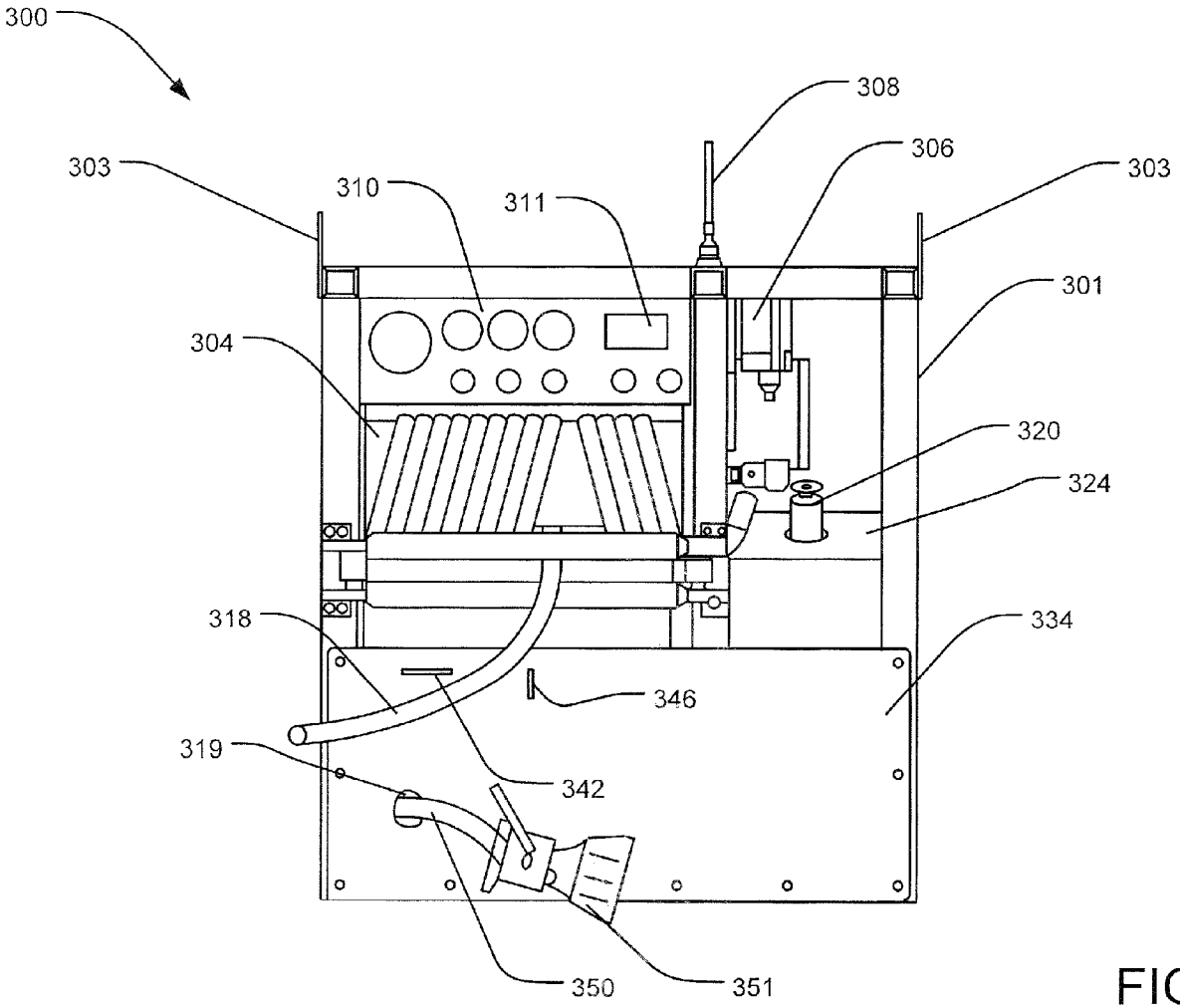
FIG. 6 illustrates a front view of a base station for an example dual capability UHP fire attack system.

FIG. 6 illustrates a front view of a base station 300 for an example dual capability ultra high pressure fire attack system. The frame 301 is shown supporting the antenna 308, a receiver module 306, the abrasives holding tank compartment 324 with tank access 320, the motorized hose reel 304, and the control panel 310. The base station hose 318 extends from a railed opening mounted on the frame 301 in front of the hose reel 304. A kick plate 334 is also mounted on the frame 301. An UHP hose 350 extends from the base station 300 through an access port 319 in kick plate 334 to provide fluid flow from the pump in the base station to the nozzle of the UHP attack line system 351.

A selector 311 on control panel 310 allows a user to select whether the dual capability UHP fire attack system operates in a fluid jet mode or an UHP attack line mode. In some implementations, the selector may be a valve or an electromechanical switch configured to operate a valve.

The high pressure pump 332 (see FIG. 7) is mounted to the frame 301 behind the kick plate 324, beneath the hose reel 304. Eyelets 303 are shown at the top of the frame 301.

A priming pump handle 342 for a priming pump 344 is accessible through the kick plate 334 to allow an operator to manually prime the high pressure pump 332 (e.g., by pulling the priming pump handle 342 in and out relative to the priming pump 344). During a priming operation, a priming valve control 346, also accessible through the kick plate 334, is set to a horizontal priming position. After a priming operation, the priming valve control 346 is set to a vertical normal operation position.

Figure 7:
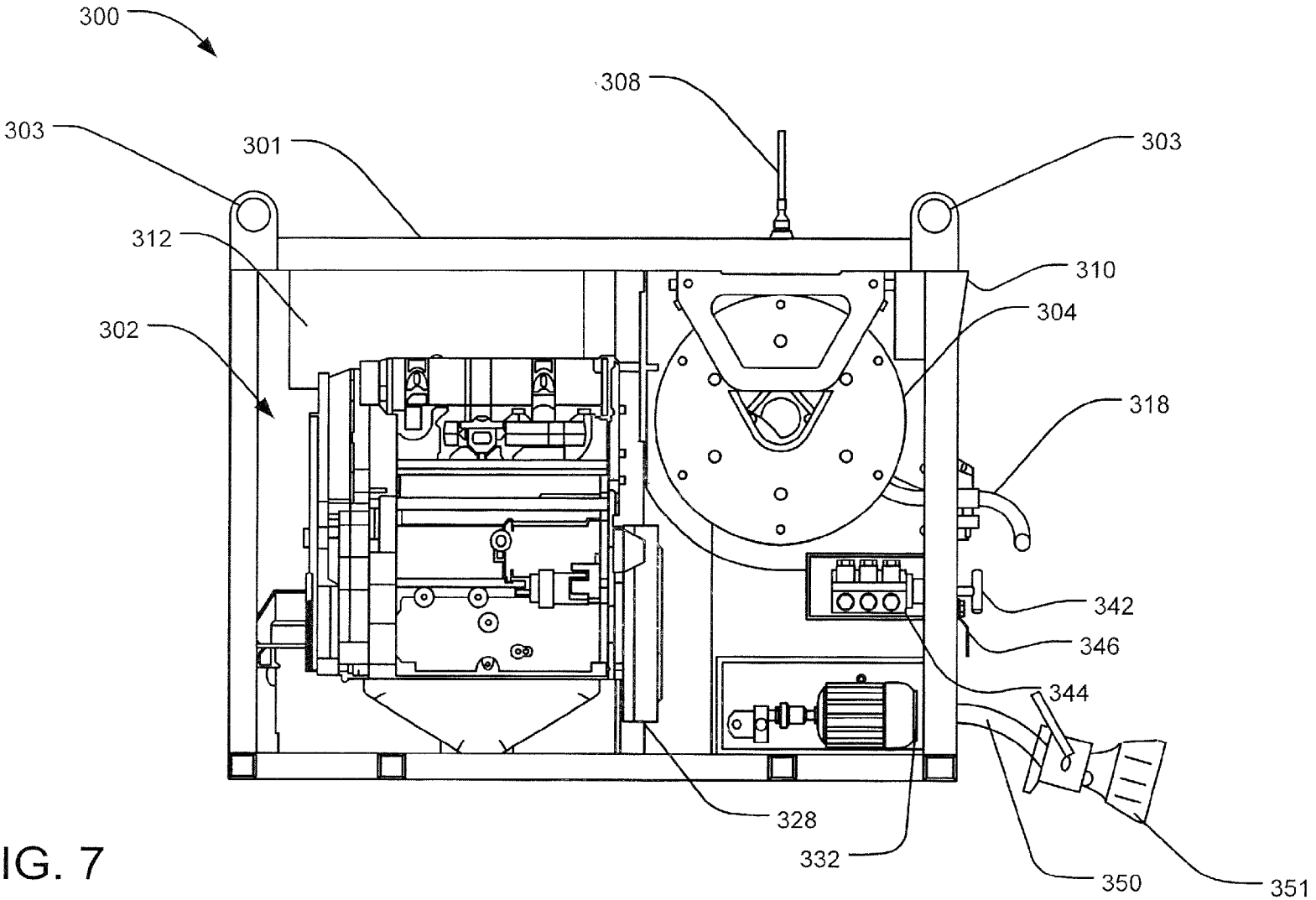
FIG. 7 illustrates a left side view of a base station for an example dual capability UHP fire attack system.

FIG. 7 illustrates a left side view of a fluid jet base station 300 for an example fluid jet system. The frame 301 is shown supporting the antenna 308, the eyelets 303, the control panel 310, the hose reel 304, the high pressure pump 332, the engine 302, and the fuel tank 312.

The pump 332 is coupled by drive belt 328 to the main shaft of the engine 302. Although not shown in FIG. 7, the charging pump is also coupled to the main shaft of the engine by another drive belt (see drive belt 328 of FIG. 4). The high pressure pump 332 drives fluid under high pressure into the manifold valves and manifold 330. The high pressure fluid stream emanating from the base station 300 flows through the base station hose 318 when one or more of the valves are open and the pump 332 is providing pressure to the flow.

An UHP hose 350 extends from the base station 300 to provide fluid flow from the pump in the base station to the nozzle of the UHP attack line system 351.

It should be appreciated that the fluid jet assembly mode of the dual capability UHP fire attack system and the UHP attack line system may be used independently, and need not be used in any particular order.

The embodiments of the invention described herein are implemented as logical steps in one or more computer systems. The logical operations of the present invention are implemented (1) as a sequence of processor-implemented steps executing in one or more computer systems and (2) as interconnected machine or circuit modules within one or more computer systems. The implementation is a matter of choice, dependent on the performance requirements of the computer system implementing the invention. Accordingly, the logical operations making up the embodiments of the invention described herein are referred to variously as operations, steps, objects, or modules. Furthermore, it should be understood that logical operations may be performed in any order, unless explicitly claimed otherwise or a specific order is inherently necessitated by the claim language.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. An ultra high pressure fire attack system, comprising:

a base station including a pump for providing a pressurized fluid;

a fluid jet assembly configured to dispense both the pressurized fluid and an additive through a cutting nozzle; and an ultra high pressure attack line system configured to dispense the pressurized fluid through a wetting nozzle.

2. An ultra high pressure fire attack system according to claim 1, further comprising a selector configured to select between operation of the fluid jet assembly and operation of the ultra high pressure attack line system.

3. An ultra high pressure fire attack system according to claim 2, wherein the selector is a valve.

4. An ultra high pressure fire attack system according to claim 1, wherein the fluid jet assembly is configured to dispense both the pressurized fluid and the additive at a pressure greater than or equal to 1500 pounds per square inch.

5. An ultra high pressure fire attack system according to claim 4, wherein the fluid jet assembly is configured to dispense both the pressurized fluid and the additive at a pressure less than or equal to 4400 pounds per square inch.

6. An ultra high pressure fire attack system according to claim 1, wherein the ultra high pressure attack line system is configured to dispense the pressurized fluid at a pressure greater than or equal to 400 pounds per square inch.

7. An ultra high pressure fire attack system according to claim 6, wherein the ultra high pressure attack line system is configured to dispense the pressurized fluid at a pressure less than or equal to 1400 pounds per square inch.

8. An ultra high pressure fire attack system according to claim 1, wherein the pressurized fluid is dispensed through the cutting nozzle as a water mist.

9. An ultra high pressure fire attack system according to claim 1, wherein the fluid jet assembly and the ultra high pressure attack line system are configured to dispense the pressurized fluid having a droplet diameter of approximately 150 microns.

10. An ultra high pressure fire attack system according to claim 1, wherein the fluid jet assembly is connected to the base station via a hose.

11. An ultra high pressure fire attack system according to claim 10, wherein the base station includes a reel for storage of the hose.

12. An ultra high pressure fire attack system according to claim 1, wherein the ultra high pressure attack line system is connected to the base station via a hose.

13. An ultra high pressure fire attack system according to claim 12, wherein the hose has an internal diameter of approximately ½ inch.

14. An ultra high pressure fire attack system, comprising:

a base station including a pump for providing a pressurized fluid;

a fluid jet assembly configured to dispense both the pressurized fluid and an aggregate through a cutting nozzle; and an ultra high pressure attack line system configured to dispense the pressurized fluid through a wetting nozzle, wherein the cutting and wetting nozzles are each configured to dispense the pressurized fluid in droplets having a diameter of approximately 150 microns, and wherein the base station is configured to operate only one of the base fluid jet assembly or the ultra high pressure attack line system at any time.

15. An ultra high pressure fire attack system according to claim 14, wherein the fluid jet assembly includes a lance connected to the base station via a hose.

16. An ultra high pressure fire attack system according to claim 14, wherein each of the cutting and wetting nozzles are connected to the base station via a hose and a high pressure coupling.

17. An ultra high pressure fire attack system according to claim 1, wherein the pressure of the ultra high pressure attack line system may be varied by a user.

18. An ultra high pressure fire attack system according to claim 1, wherein the additive is an aggregate and the pressurized fluid is water.

19. An ultra high pressure fire attack system according to claim 1, wherein the additive is a foam and the pressurized fluid is water.

20. An ultra high pressure fire attack system according to claim 1, wherein the base station includes a holding tank for storing the additive, and the base station is remote from a user operating the fluid jet assembly.

21. An ultra high pressure fire attack system, comprising:

a base station including a pump for providing a pressurized fluid;

a fluid jet assembly configured to dispense both the pressurized fluid and an aggregate through a cutting nozzle, wherein the fluid dispensed through the cutting nozzle is configured to reduce the ambient temperature within an enclosure containing a fire; and an ultra high pressure attack line system configured to dispense the pressurized fluid through a wetting nozzle, wherein the fluid dispensed through the wetting nozzle is configured to wet a fuel source of the fire.

22. A method for using a ultra high pressure fire attack system to extinguish a fire, comprising:

pressurizing a fluid using a base station including a pump;

cutting through a wall of an enclosure containing a fire using a pressurized flow of the fluid and an aggregate through a fluid jet assembly nozzle;

streaming a pressurized flow of the fluid through the fluid jet assembly nozzle and into the enclosure, wherein the fluid dispensed through the fluid jet assembly nozzle is configured to reduce the ambient temperature within the enclosure; and directing a pressurized flow of the fluid through an ultra high pressure attack line system nozzle and to a fuel source of the fire.

* * * * *